US006478496B1

(12) United States Patent
Yoshii et al.

(10) Patent No.: US 6,478,496 B1
(45) Date of Patent: Nov. 12, 2002

(54) INK FOLLOWER FOR WRITING TOOL

(75) Inventors: Kazuhiro Yoshii, Gunma (JP); Seishi Izumi, Kanagawa (JP); Teruaki Fukasawa, Gunma (JP)

(73) Assignee: Kabushiki Kaisha Pilot, Tokyo (JP)

( * ) Notice: Subject to any disclaimer, the term of this patent is extended or adjusted under 35 U.S.C. 154(b) by 0 days.

(21) Appl. No.: 10/066,733

(22) Filed: Feb. 6, 2002

(30) Foreign Application Priority Data

Mar. 16, 2001 (JP) ..... 2001-120342

(51) Int. Cl.[7] ..... B43K 7/08
(52) U.S. Cl. ..... 401/142; 401/141
(58) Field of Search ..... 401/141, 142, 401/222

(56) References Cited

U.S. PATENT DOCUMENTS 6,200,053 B1 * 3/2001 Asami et al. ..... 401/142
6,227,738 B1 * 5/2001 Ogura et al. ..... 401/142
6,406,204 B1 * 6/2002 Omatsu et al. ..... 401/142

* cited by examiner

*Primary Examiner*—David J. Walczak
(74) *Attorney, Agent, or Firm*—Rader, Fishman & Grauer PLLC

(57) ABSTRACT

An ink follower for a writing tool arranged in close contact with an ink surface of a terminal portion of an ink reservoir opposite to a writing tip portion comprises a swollen gel formed from an oil-absorbable resin, a base oil of polybutene, and an alkyl-modified silicone oil compatible with the polybutene. The ink follower exhibits improved impact resistance without causing insufficient ink following and oil separation.

5 Claims, No Drawings

INK FOLLOWER FOR WRITING TOOL

TECHNICAL FIELD OF THE INVENTION

The present invention relates to an ink follower for writing tools. More particularly, for the purpose of preventing ink contained in an ink reservoir from evaporation during storage or in use and preventing the ink from leakage in a writing tool, the invention relates to an ink follower for a writing tool arranged in close contact with ink surface at the terminal portion opposite to the portion to which an writing tip is attached.

BACKGROUND OF THE INVENTION

An ink follower is a gel-type stopper which is arranged on the upper ink surface at the terminal portion opposite to the portion of the ink reservoir of a ballpoint pen to which an writing tip is attached, and which adheres closely to the ink-containing reservoir and comes down with tightly sealing it, following the ink with the consumption of the ink.

Hitherto, in a writing tool wherein ink for writing is directly contained in an ink-containing reservoir, e.g., a ballpoint pen, an ink follower is charged in close contact with the ink at the terminal portion of the ink reservoir for the purpose of the prevention of evaporation and leakage of the ink. The ink follower should not only be hardly volatile but also have high apparent viscosity for the prevention of leakage of the ink. For satisfying such requirements, ink followers wherein an organic or inorganic thickening agent or a gelling agent is added, as a viscosity-imparting agent, to a base oil of a hardly volatile liquid or a nonvolatile liquid have been known. For example, Japanese Examined Patent Publication No. 64-010554/1989 proposes a follower wherein an organic gelling agent such as dibenzylidene sorbitol is added to a hardly volatile solvent such as ethylene glycol, and Japanese Laid-Open Patent Publication No. 57-200472/1982 proposes a composition wherein an thickening agent such as an amino acid derivative is dissolved in polybutene or the like to form a gel.

In addition, those wherein an organic or inorganic thickening agent, a gelling agent or the like is added to a base oil of a hardly volatile liquid or a nonvolatile liquid and a specific additive is further added as a performance improving agent are proposed in Japanese Examined Patent Publication Nos. 5-082840/1993, 6-015277/1994, 6-033025/1994, 6-033026/1994, 6-047318/1994, 7-029513/1995, Japanese Patent No. 2677734, Japanese Laid-open Patent Publication Nos. 4-202281/1992, 5-270193/1993, 6-200235/1994, 7-216285/1995, 8-11481/1996, 8-300874/1996, 9-234988/1997.

These ink followers are viscoelastic gel substances which are thickened by the formation of network between molecules of a gelling agent. Since this network gradually grows finely and densely with the passage of time to form stronger gel substance, there is a problem that it becomes difficult to follow the consumption of ink resulted from writing. In the worst case, a reduced-pressure space is formed between the ink follower and ink surface, there arises a problem that an ink flow is discontinued or writing becomes impossible. It is possible to solve the problem of the following performance by reducing the adding amount of the gelling agent because the network formation can be limited to the minimum. In this case, however, a sufficient apparent viscosity cannot be attained and thus the follower does not form a stopper having a required hardness, so that it cannot prevent the leakage of ink. In addition, when the adding amount of the gelling agent is reduced, there is a problem that an oil separation, i.e., the separation of portion of the base oil of the ink follower occurs and then writing becomes impossible when the oil independently stays at the terminal part.

Furthermore, Japanese Laid-open Patent Publication No. 8-142570/1996 proposes an ink follower wherein a phthalate ester-type plasticizer and a polyester-type thermoplastic elastomer are combined. In the ink follower, it is attempted to cope with both the stability with the passage of time and the control of flow rate of ink but the ink follower is inferior in impact resistance, so that there is a problem that ink leaks out when external force is applied by, for example, falling, vibration or the like.

In such situation, for enhancing impact resistance, the addition of non-swellable particles having a similar specific gravity to that of the base oil and a particle size of several tens to several hundreds $\mu$m or the incorporation of rod-shaped materials of several mm is proposed in Japanese Laid-open Patent Publication Nos. 10-044673/1998 and 10-067196/1998 but the problem of the oil separation is not yet solved.

SUMMARY OF THE INVENTION

As described above, there is no proposal of the ink follower having sufficient stability with the passage of time, impact resistance and ink-following ability as well as showing no oil separation.

The present invention provides an ink follower for writing tools exhibiting an excellent following ability which have an enhanced impact resistance without causing insufficient following and oil separation with the passage of time as well as any inconvenience such as writing failure.

The present invention relates to an ink follower for a writing tool, such as a ballpoint pen. The ink follower is to be arranged in close contact with ink surface of a terminal portion opposite to a writing tip portion of an ink reservoir of the writing tool. Particularly, the ink follower is swollen gel formed from an oil-absorbable resin and a base oil of polybutene and an alkyl-modified silicone oil compatible with said polybutene. Viscosity of the base oil may range from 500 to 2000 $mm^2/s$ at measuring environment of 40° C. and unmixing consistency may range from 320 to 380 at measuring environment atmosphere of 25° C. Mixing amount of the oil-absorbable resin may be from 10 to 20% by weight based on the total amount of the follower. The oil-absorbable resin may be one or more selected from acrylate ester crosslinked polymers and/or copolymers thereof, (meth) acrylate ester crosslinked polymers and/or copolymers thereof, and polynorbornene The adding amount of the alkyl-modified silicone oil may be from 0.5 to 1.5% by weight.

PREFERRED EMBODIMENTS OF THE INVENTION

The ink follower of the present invention is a swollen gel substance obtained by mixing thoroughly a base oil of polybutene and an alkyl-modified silicone oil compatible with the polybutene beforehand under an environment of 100 to 500° C., and then adding an oil-absorbable resin to swell the resin under mixing.

In the present invention, an oil-absorbable resin is employed as the thickening agent for the ink follower. The oil-absorbable resin to be used in the present invention is a resin having a property of stably holding the base oil through swelling after absorbing the oil, and a desired ink follower may be obtained by using one of the resins or two or more of the resins in combination.

As mentioned above, the conventional ink followers are gel substances formed by intermolecular network structures by weak hydrogen bond or van der Waals force. On the other hand, the ink follower of the present invention employing an oil-absorbable resin is formed by an intramolecular gel structure. As mentioned above, since the intermolecular network grows with the passage of time, initial design is extremely difficult but also there still remains a problem of an external force caused by an impact or the like. That is, when an external force is applied to the ink follower, the intermolecular network is broken to cause a rapid decrease of apparent viscosity, whereby impact resistance decreases. On the other hand, since the ink follower employing the oil-absorbable resin is formed by an intramolecular gel structure, the rapid decrease of apparent viscosity does not occur even when an external force is applied, and the breakage of the structure by the external force does not occur. Accordingly, owing to the large difference of the gel formation mechanism, the employment of the oil-absorbable resin results in advantages that a stable structure against an external force such as an impact can be always obtained and the substance does not change with the passage of time.

The intramolecular gel structure is now explained. The intramolecular gel forms a structure capable of holding a base oil by van der Waals force in the intramolecular crosslinked polymer chains of the oil-absorbable resin. The formation of the structure to form the gel occurs at the time when the oil-absorbable resin absorbs the base oil, and after the oil absorption, it forms a complete gel structure, so that further structural formation does not occur with the passage of time and the substance change with the passage of time as in the case of the intramolecular network gel does not occur. Moreover, since the gel structure is formed not intermolecularly but only intramolecularly, the breakage of the structure by an external force does not occur and thus the intrinsic gel structure is restored at the same time when the external force is removed.

As the oil-absorbable resin to be used in the present invention, there may be mentioned an acrylate ester crosslinked polymer and/or copolymer thereof, a methacrylate ester crosslinked polymer and/or copolymer thereof, and polynorbornene, and the like. The following exemplify the crosslinked polymers. As the acrylate ester crosslinked polymers, there may be mentioned a crosslinked polymer composed of 99.734% by weight of decyl acrylate and 0.266% by weight of 1,6-hexanediol acrylate, a crosslinked polymer composed of 99.823% by weight of dodecyl acrylate and 0.177% by weight of ethylene glycol diacrylate, a crosslinked polymer composed of 92.308% by weight of dodecyl acrylate and 7.692% by weight of polypropylene glycol methacrylate (Mw 4000), and the like.

As the acrylate ester crosslinked copolymers, a crosslinked polymer composed of 57.7724% by weight of dodecyl acrylate, 38.515% by weight of N,N-dioctylacrylamide and 3.713% by weight of polypropylene glycol dimethacrylate (Mw 4000) and the like may be mentioned.

As the methacrylate ester crosslinked polymers, a crosslinked polymer composed of 99.895% by weight of hexadecyl methacrylate and 0.105% by weight of divinylbenzene and the like may be mentioned.

As the methacrylate ester crosslinked copolymers, there may be mentioned a crosslinked polymer composed of 49.930% by weight of hexadecyl methacrylate, 49.930% by weight of N-octylmethacrylamide and 0.140% by weight of divinylbenzen, a crosslinked polymer composed of 59.908% by weight of hexadecyl methacrylate, 39.938% by weight of butyl methacrylate and 0.154% by weight of divinylbenzen, and the like.

The more concrete examples of the oil-absorbable resin include Oleosorb PW-190 and Oleosorb PW-170 (both manufactured by Nippon Shokubai Co., Ltd.) as acrylate ester crosslinked polymers, Norsorex (manufactured by Nippon Zeon Co., Ltd.) as polynorbornene, and the like.

The mixing amount of the above oil-absorbable resin should be at least the amount which is sufficient to absorb all the base oil, but is preferably from 10 to 20% by weight based on the total weight of the ink follower. When the amount is less than 10% by weight, there is no particular problem at the use in a standing state but there are a tendency of decrease of impact resistance and also a possibility of occurrence of oil separation. When it exceeds 20% by weight, there are tendencies of decrease of smoothness and decrease of following ability. The above tendencies are increased in the use at a high temperature when the amount is less than 10% by weight or in the use at a low temperature when the adding amount exceeds 20% by weight.

In addition, polybutene is employed as the base oil of the ink follower in the present invention.

As the base oil of the ink follower, silicone, oil, castor oil, liquid paraffin, mineral oil and the like may be alternatively utilized, but there arises a limitation on the design of physical properties of the ink follower owing to the continuous risk of oil separation with the passage of the time, unless the oil-absorbing state toward the oil-absorbable resin is satisfactory. The present invention relates to an ink follower for writing tools, and aims actively at the realization of stable and good performance of writing tools at any time under a wide range of environment of using writing tools. Because a large influence on the performance of writing tools is resulted in, it is not preferable to occur a large divergence between the properties at a high temperature and the properties at a low temperature caused by the occurrence of the limitation on the design of physical properties owing to the risk of oil separation. Therefore, it is important to employ an oil-absorbable resin and a base oil which results in an especially stable oil absorbing state.

As a result of extensive examinations, the present inventors have found that the viscosity of the base oil affects impact resistance and ink-following performance and also the extent of the effects depends on the compositional factors such as the kind of the thickening agent, the kind of the base oil and the like used in the ink follower. When the viscosity of the base oil is high, it is commonly known that the defect of the structural breakage of the ink follower by the impact occurring in the case of dropping the writing tool or the like, but a problem of ink following performance occurs. Of course, in the case that the viscosity of the base oil is low, the reverse of the phenomena occurs. The base oil comprises oil components and therefore, the viscosity of the base oil widely changes with the change of environment such as temperature. Since the present invention aims to stabilize actively the performance of writing tools under a wide range of environment, the selection of the base oil is an important factor of the constitution of the invention.

Writing tools are used even at a relatively high temperature environment of more than 40° C. As a result of extensive examinations for thoroughly preventing the structural breakage of an ink follower derived from impact resistance at a high temperature, the present inventors has reached the conclusion detailed below.

When an ink follower is positively designed based on viscosity characteristics, the performance thereof largely varies with the change of surrounding temperature. In the case of general oil components, the viscosity sometimes decreases to about ½ of the original viscosity by 10° C. increase in temperature. On the other hand, the conventional ink follower formed by an intermolecular network structure is poor in structural resistance against an external force such as an impact because the network structure is immediately broken when an external force such as an impact is applied. From the analysis of the above, in the ink follower formed by an intermolecular network structure, the network is easily broken when an external force is generated, so that the retention of performance of impact resistance necessarily depends on the viscosity of the base oil. Furthermore, the viscosity of the base oil is prone to vary with temperature, it becomes strongly necessary to set an extremely high viscosity for imparting a high temperature properties. When an ink follower is designed in such a manner, a big problem on the ink following ability occurs as a matter of course at a low temperature where the viscosity increases.

From the analysis of the above, they have found it extremely important requirement for obtaining an ink follower for writing tools to employ an oil-absorbable resin forming a gel without oil separation as a thickening agent for attaining a stable performance and to select a base oil forming a stable oil-absorbed state with the oil-absorbable resin. Furthermore, it is experimentally elucidated that polybutene employed in the present invention not only results in a stable oil-absorbed state but also has a performance capable of maintaining impact resistance even at a relatively low viscosity. The present inventors have confirmed the effects of polybutene as experimental results and main cause thereof is analyzed to be the strong compatibility with polypropylene widely employed as a material for ink reservoirs. The resistance against an external force at a relatively low viscosity means no extreme decrease in the resistance against an external force and ability of maintaining a stability even when a viscosity decrease occurs at a high temperature. In addition, as a low temperature property, the ink following ability does not decrease and initial performance can be maintained.

Suitable viscosity for polybutene employed in the present invention is from 500 to 2000 $mm^2/s$ measured at measuring environment of 40° C. Since the action depends on the characteristics of ink to be employed for writing tools and the structure of the reservoir in which ink and ink follower are contained, it is difficult to say categorically, but, according to the present invention, it is possible to obtain a stable ink follower for writing tools exhibiting no structural breakage of the ink follower, the breakage being due to an impact resistance at a high temperature.

When the viscosity of polybutene is lower than 500 $mm^2/s$ under measuring environment of 40° C., the resistance against an external force tends to decrease under a relatively high temperature environment, for example, higher than 40° C. On the other hand, when the viscosity of polybutene is higher than 2000 $mm^2/s$ under measuring environment of 40° C., an ink following ability decreases at a low temperature environment, for example, lower than 10° C. and a ink flow sometimes decreases at high speed writing. Although the use as writing tools is not necessarily in the temperature range, it is practically preferable to exhibit good writing ability in this temperature range.

Moreover, in the case that the viscosity of a base oil of polybutene is in the range of 500 to 2000 $mm^2/s$ at measuring environment of 40° C., the most preferable physical properties for an ink follower can be attained by making unmixing consistency of an ink follower 320 to 380 at measuring environment of 25° C. Although the ink following ability largely depends on the design of ink reservoir, a very hard ink follower is obtained when the consistency at measuring environment of 25° C. is less than 320, and an insufficient ink following tends to occur in the use under low temperature environment. When the consistency exceeds 380, a phenomenon of oil separation tends to occur owing to the occurrence of upper limit of the adding amount of the oil-absorbable resin. Furthermore, impact resistance decreases in the use at a high temperature. Therefore, the above range is preferable.

The methods for measuring physical properties are as follows. The viscosity was measured at a measuring environment of 40° C. using Cannon-Fenske viscosimeter in accordance with JIS K 2283. And, the consistency was measured at a measuring environment of 25° C. in accordance with the measuring method defined in JIS K 2220 5.3.

Moreover, the present invention has a characteristic of adding an alkyl-modified silicone oil compatible with the above polybutene.

It is generally known that silicone-type oils such as an alkyl-modified silicone oil is applicable as a lubricant, but the main reason of employing the oil in the present invention is because the alkyl-modified silicone oil is compatible with polybutene. Among the silicone-type oils, the alkyl-modified silicone oil is excellent in compatibility with polybutene and also has a good lubricating ability. Furthermore, a large effect is exhibited by combining it with an oil-absorbable resin which absorbs polybutene.

Although academic elucidation is not necessarily sufficient, the present inventors have found the effectiveness of use of the alkyl-modified silicone oil from extensive studies. The effectiveness of the oil-absorbable resin and polybutene on the enhancement of the resistance against an external force is as mentioned above. However, according to the study of the present inventors, it is an undeniable truth that the resistance against an external force and an ink following performance are contradictory properties. It is a simple methodology to utilize a lubricating performance of a silicone-type oil for ink following ability, but the silicone-type oil is generally difficult to be absorbed to an oil-absorbable resin, and tends to occur oil separation as an independent component in an ink follower system. Thus, the inventors have intended to make the oil well compatible with polybutene employed as a base oil. Good compatibility with polybutene results in disappearance of the independent silicone-type oil in the gel structure and the oil is included in the gel of the oil-absorbable resin. Moreover, the lubricating performance of the silicone-type oil included in the gel does not deteriorate. The present inventors have verified this fact by confirming the ink following ability in oil separation test defined in JIS K 2220 5.7 and in every writing test. There are examples wherein a silicone-type oil is employed solely or as an additive. In all the examples, however, no oil-absorbable resin is used as a thickening agent and a gel substance is formed by intermolecular network structure, which exhibit intrinsically good lubricating performance and require no incorporation of the silicon-type oil for improving lubricating property. The oil is merely used as a base oil. Therefore, the deterioration of ink following ability and the resistance against an external force cannot be improved and thus these problems still remain.

Examples of the alkyl-modified silicone oil employable in the present invention include SH203, SH230 and SF8416

(all manufactured by Toray-Dow Corning Silicone Co., Ltd.) as suitable materials.

The adding amount of the alkyl-modified silicone oil employed in the present invention is suitably in the range of 0.5% by weight to 1.5% by weight based on the total amount of the ink follower. When the amount is less than 0.5% by weight, the effect of lubrication is difficult to attain, and thus an insufficient ink following tend to occur in the use of writing tools under a low temperature environment, which is impossible to solve by mere design of physical properties of the ink follower. Also, when the adding amount exceeds 1.5% by weight, oil separation tends to occur owing to off-balance of stable oil absorption in the molecule of the oil-absorbable resin, which results in a lowered impact resistance. The reason for the lowered impact resistance is considered that an elastic behavior which the oil-absorbable resin intrinsically has cannot be realized because the stability of oil absorption cannot be maintained because the adding amount of the alkyl-modified silicone oil is too much, in addition to the oil separation.

EXAMPLES

The following will explain concretely the present invention with reference to Examples.

Example 1

| | |
|---|---|
| An oil absorbable resin | 10.0% by weight |
| Polybutene | 89.0% by weight |
| An alkyl-modified silicone oil | 1.0% by weight |

Polybutene (Trade name: HV-15; manufactured by Nippon Petrochemicals Co., Ltd.) adjusted the viscosity at a measuring environment of 40° C. to 1500 $mm^2/s$ beforehand and an alkyl-modified silicone oil (Trade name: SH203; Toray-Dow Coring Silicone Co., Ltd.) were heated to 140° C. and mixed. Then, an oil-absorbable resin, acrylate ester crosslinked polymer (Trade name: OLEOSORB PW170; manufactured by Nippon Shokubai Co., Ltd.) was homogeneously stirred and swollen and then gradually cooled to room temperature to obtain a gel-form ink follower for writing tolls. The unmixing consistency of the ink follower was 360 at a measuring environment of 25° C.

Examples 2 to 8

Gel-form ink followers for writing tools were obtained in a similar manner to Example 1 with the exception that the formulations of the ink followers were as shown in Table 1.

TABLE 1

| | | Example | | | | | | | |
|---|---|---|---|---|---|---|---|---|---|
| | | 1 | 2 | 3 | 4 | 5 | 6 | 7 | 8 |
| Oil-absorbable resin | | 10.0 | 10.0 | 10.0 | 9.0 | 12.S | 12.5 | 10.0 | 12.0 |
| Polybutene (viscosity 1500 $mm^2/s$) | | 89.0 | 89.6 | 88.5 | 90.5 | 86.0 | 86.5 | | |
| Polybutene (viscosity 500 $mm^2/s$) | | | | | | | | 89.5 | |
| Polybutene (viscosity 2000 $mm^2/s$) | | | | | | | | | 86.5 |
| Alkyl-modified silicone oil | | 1.0 | 0.4 | 1.5 | 0.5 | 1.5 | 1.0 | 0.5 | 1.5 |
| Consistency of ink follower | | 360 | 360 | 360 | 380 | 320 | 320 | 320 | 380 |
| Ink following performance | 5° C. | ○ | Δ | ○ | ○ | ○ | ○ | ○ | ○ |
| | 40° C. | ○ | Δ | ○ | ○ | ○ | ○ | ○ | ○ |
| Performance of impact resistance | 5° C. | ○ | ○ | ○ | ○ | ○ | ○ | ○ | ○ |
| | 40° C. | ○ | ○ | Δ | ○ | ○ | ○ | ○ | ○ |
| Oil separation | ○ | ○ | ○ | ○ | ○ | ○ | ○ | ○ | |

Comparative Example 1

A gel-form ink follower for writing tools was obtained in a similar manner to Example 1 with the exception that a general silicone oil having a bad compatibility (Trade name: SH200; Toray-Dow Coring Silicone Co., Ltd.) was employed instead of the alkyl-modified silicone oil compatible with polybutene.

Comparative Example 2

The absorption of oil to the oil-absorbable resin (Trade name: OLEOSORB PW170; manufactured by Nippon Shokubai Co., Ltd.) was attempted using an alkyl-modified silicone oil (Trade name: SH200; Toray-Dow Coring Silicone Co., Ltd.) as a base oil without polybutene, but no gel was formed owing to insufficient absorption of the oil.

Comparative Example 3

The formulation of an ink follower was as shown in Table 2. AEROSIL (Trade name: AEROSIL R972; manufactured by Nippon Aerosil Co., Ltd.) was added to a base oil of polybutene without any oil-absorbable resin and the whole was kneaded with a three-roll mill until aerosil was dispersed homogeneously to obtain a gel-form ink follower for writing tools.

Comparative Example 4

The formulation of an ink follower was as shown in Table 2. AEROSIL (Trade name: AEROSIL R972; manufactured by Nippon Aerosil Co., Ltd.) was added to a base oil of a silicone oil (Trade name: SH200; Toray-Dow Coring Silicone Co., Ltd.) without any oil-absorbable resin and the whole was kneaded with a three roll mill until AEROSIL was dispersed homogeneously to obtain a gel-form ink follower for writing tools.

Comparative Examples 5 to 8

Comparative Examples 5 to 8 evidence that the viscosity of the base oil is preferably from 500 to 2000 $mm^2/s$ at measuring environment of 40° C. and the unmixing consistency is preferably from 320 to 380 at measuring environment of 25° C. Furthermore, the mixing amount of the oil-absorbable resin is preferably from 10 to 20% by weight based on the total amount of the follower Gel-form ink followers for writing tools were obtained in a similar manner to Example 1 with the exception that the formulations of ink followers were as shown in Table 2.

TABLE 2

| | | Comparative Example | | | | | | | |
|---|---|---|---|---|---|---|---|---|---|
| | | 1 | 2 | 3 | 4 | 5 | 6 | 7 | 8 |
| Oil-absorbable resin | | 10.0 | 10.0 | | | 8.5 | 12.0 | 14.0 | 7.5 |
| Aerosil | | | | 9.0 | 5.0 | | | | |
| Polybutene (viscosity 400 $mm^2/s$) | | | | | | 90.5 | | | |
| Polybutene (viscosity 1500 $mm^2/s$) | | 90.0 | | 90.0 | | | | 85.0 | 91.5 |
| Polybutene (viscosity 2100 $mm^2/s$) | | | | | | | 87.0 | | |
| Silicone oil | | 1.0 | 90.0 | | 95.0 | | | | |
| Alkyl-modified silicone oil | | | | 1.0 | | 1.0 | 1.0 | 1.0 | 1.0 |
| Consistency of ink follower | | 360 | — | 320 | 320 | 380 | 360 | 300 | 410 |
| Ink following performance | 5° C. | x | not thickened | x | x | ○ | x | x | ○ |
| | 40° C. | x | | ○ | ○ | ○ | x | x | ○ |
| Performance of impact resistance | 5° C. | ○ | | x | x | x | ○ | ○ | x |
| | 40° C. | ○ | | x | x | x | ○ | ○ | x |
| Oil separation | | x | not thickened | x | ○ | ○ | ○ | ○ | ○ |

Evaluation Methods

An ink (1.0 g) for a water-base ballpoint pen having the following composition was charged into an ink reservoir made of polypropylene having an inner diameter of 4 mm, and each ink follower (0.15 g) obtained in Examples and Comparative Examples was charged to the terminal portion of the ink. Degassing was conducted by applying a centrifugal force of 900G toward the direction of pen tip so that the terminal portion of the ink and the ink follower come into close contact. By the way, a stainless tip having a ball diameter of 0.7 mm was employed as the pen tip, the tip being the one generally employed by K.K. PILOT for a ballpoint pen with a water-base gel ink.

| (Ink formulation) | |
|---|---|
| Direct Black 154 (manufactured by Orient Chemical Industries K.K.) | 7.5% by weight |
| An acrylic acid crosslinked polymer (Trade name: HIVISWAKO 104; manufactured by Wako Pure Chemical Industries, Ltd.) | 0.7% by weight |
| Ethylene glycol | 15.0% by weight |
| pH Regulator (triethanolamine) | 1.0% by weight |
| Antirust lubricant (Trade name: PLYSURF A-208S; manufactured by Dai-ichi Kogyo Seiyaku) | 0.2% by weight |
| Antibacterial agent (Trade name: PROXCEL XL-2; manufactured by Avecia K.K.) | 0.2% by weight |
| Ion-exchange water | 75.4% by weight |

Evaluation was Conducted as Follows:

An ink-following performance test and an impact resistance test were carried out with placing the ballpoint pens built as above under environments of 5° C. and 40° C. The tests were carried out with the same standard after standing the ballpoint pens sideways for 3 hours under each environment. Moreover, the ballpoint pens built were left to stand with the tip upward at 80° C. for 2 weeks and oil separation was examined.

Ink-Following Ability Test:

Continuous spiral writing at a rate of 10 m/minute, a diameter of 10 cm, and a length of 100 m was carried out, and the written line and the ink flow were evaluated. The test was carried out under environments of 5° C. and 40° C. ○: Entirely normal ink flow was maintained and a good written line was continuously maintained. Δ: During the continuous writing, ink flow became apt to decrease or a written line was patchy. X: Ink flow was apt to decrease and a written line was patchy from the start of writing.

Impact Resistance Test:

The capped ballpoint pens with the tip upward were dropped vertically from the height of 1 m to a Japanese cedar plate successively 100 times. Thereafter, the state of the ink follower was evaluated visually. ○: The shape of the ink follower was not changed from the initial state. Δ: The shape of the ink follower was changed but no ink leakage was observed. X: The shape of the ink follower was broken and leakage of ink was observed.

Oil Separation:

The capped ballpoint pens were left to stand sideways at 80° C. for 2 weeks, and then oil separation in the ink was evaluated. ○: No oil floating was detected in the ink. Δ: Slight oil floating was detected in the ink but there was no problem in writing. X: Oil floating was detected in the ink and there was also a problem in writing.

Evaluation Results

In Examples 1 to 8, good results were obtained as ink followers for writing tools as shown in Table 1.

Comparative Example 1 is an example wherein a general silicone oil having no compatibility with polybutene is used instead of the alkyl-modified silicone oil. The silicone oil used was not absorbed and separated in the ink follower to result in oil separation. Moreover, the lubricating performance of whole ink follower was not improved owing to the independency from the swollen gel state of the oil-absorbable resin.

Comparative Example 2 is an example wherein a silicone oil was solely selected as the base oil. The oil was not absorbed by the oil-absorbable resin and thus no gel was formed, so that the function as ink follower was not exhibited.

Comparative Example 3 is an example wherein aerosil is used as the thickening agent. As explained in the specification, since the gel formation of aerosil was derived from an intermolecular network structure, good impact resistance was not observed owing to the breakage of the network structure by an external impact. Moreover, the network structure was broken by the action of surface activity of the ink with the passage of time, whereby a plenty of oil separation occurred.

Comparative Example 4 is an example wherein an ink follower is formed only from aerosil and a silicone oil. Since the compatibility between the silicone oil and the ink was extremely low, the breakage of the network with the passage of time did not occur, but good impact resistance was not observed owing to the same reason as in Comparative Example 3.

Comparative Example 5 is an example wherein the viscosity of the base oil of polybutene is as low as 400 $mm^2/s$. Ink following ability becomes good but impact resistance is poor. This is analyzed that an impact act as a direct external force without absorption because of the decrease of viscous behavior of the ink follower.

Comparative Example 6 is an example wherein the viscosity of the base oil of polybutene is as high as 2100 $mm^2/s$. Phenomena reverse to those in Comparative Example 5 are observed and ink following ability is poor.

Comparative Example 7 is an example wherein the mixing amount of the oil-absorbable resin is large and the consistency of the ink follower is very low. The low consistency means that the ink follower is hard, and thus ink following ability is poor.

Comparative Example 8 is the reverse to Comparative Example 7, and the ink follower is soft and impact resistance is poor.

The ink follower of the present invention is excellent in impact resistance and ink following ability, and exhibits an excellent effect that no oil separation occurs.

The disclosure of Japanese Patent Application No. 2001-120342 filed Mar. 15, 2001 including specification, drawings and claims is incorporated herein by reference in its entirety.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. An ink follower for a writing tool to be arranged in close contact with ink surface of a terminal portion of an ink reservoir of the writing tool comprising: a swollen gel formed from an oil-absorbable resin; a base oil of polybutene; and an alkyl-modified silicone oil compatible with said polybutene.

2. The ink follower for a writing tool according to claim 1, wherein the viscosity of the base oil is from 500 to 2000 $mm^2/s$ at measuring environment of 40° C. and unmixing consistency of the base oil is from 320 to 380 at 25° C.

3. The ink follower for a writing tool according to claim 2, wherein the mixing amount of the oil-absorbable resin is from 10 to 20% by weight based on total amount of the follower.

4. The ink follower for a writing tool according to claim 1, wherein the oil-absorbable resin is one or more selected from acrylate ester crosslinked polymers and/or copolymers thereof, (meth)acrylate ester crosslinked polymers and/or copolymers thereof, and polynorbornene.

5. The ink follower for a writing tool according to claim 1, wherein the amount of the alkyl-modified silicone oil is from 0.5 to 1.5% by weight base d on total amount of the follower.

* * * * *